US006153866A

United States Patent [19]

Andersson et al.

[11] Patent Number: 6,153,866

[45] Date of Patent: Nov. 28, 2000

[54] MICROWAVE OVEN WITH A GRILLING DEVICE

[75] Inventors: Ann-Marie Andersson; Nyrén Gunnar, both of Norrköping, Sweden

[73] Assignee: Whirlpool Corporation, Benton Harbor, Mich.

[21] Appl. No.: 09/355,146

[22] PCT Filed: Jan. 20, 1998

[86] PCT No.: PCT/EP98/00280

§ 371 Date: Sep. 24, 1999

§ 102(e) Date: Sep. 24, 1999

[87] PCT Pub. No.: WO98/34436

PCT Pub. Date: Aug. 6, 1998

[30] Foreign Application Priority Data

Jan. 30, 1997 [SE] Sweden ..... 9700280

[51] Int. Cl.[7] ..... H05B 6/80

[52] U.S. Cl. ..... 219/685; 219/738; 219/756

[58] Field of Search ..... 219/685, 680, 219/736, 738, 745, 756

[56] References Cited

U.S. PATENT DOCUMENTS

| | | | |
|---|---|---|---|
| 2,920,174 | 1/1960 | Haagensen | 219/685 |
| 3,878,350 | 4/1975 | Takagi | 219/685 |
| 4,728,763 | 3/1988 | Bell et al. | 219/685 |
| 4,761,529 | 8/1988 | Tsisios | 219/685 |
| 5,147,993 | 9/1992 | Braun et al. | 219/685 |
| 5,313,036 | 5/1994 | Chartrain et al. | 219/746 |

FOREIGN PATENT DOCUMENTS

| | | |
|---|---|---|
| 0 053 189 | 6/1982 | European Pat. Off. . |
| 0 380 158 | 8/1990 | European Pat. Off. . |
| 0 573 750 | 12/1993 | European Pat. Off. . |
| 43 22 946 | 1/1995 | Germany . |
| 2 152 790 | 8/1985 | United Kingdom . |

*Primary Examiner*—Philip H. Leung
*Attorney, Agent, or Firm*—Robert O. Rice; Joel M. Van Winkle; Thomas J. Roth

[57] ABSTRACT

A microwave oven with an oven capacity (3) which is designed so that a part (9) of the cavity is essentially free of microwave radiation, in which part (9) is arranged a grill element which radiated IR radiation. The microwave-free space is obtained by a special dimensioning of the connection opening between the actual oven cavity, in which foodstuffs are heated by means of microwave radiation, and the microwave-free space (9).

9 Claims, 3 Drawing Sheets

MICROWAVE OVEN WITH A GRILLING DEVICE

FIELD OF THE INVENTION

The present invention relates to a method and a device for IR irradiation of foodstuffs in a microwave oven. In particular, the present invention relates to a device and a method for the arrangement of IR radiating elements in a microwave oven.

TECHNICAL BACKGROUND AND PRIOR ART

At the present time, there are known microwave ovens which comprise grill elements, i.e. means for irradiation of foodstuffs which are to be cooked in the oven with IR radiation, in order to create a grilled texture of said foodstuffs.

The conventional method is to arrange grill elements outside the oven cavity, in a so-called grill bulge, in order to avoid creating serious disturbances of the microwave pattern in the oven cavity. However, this results in new problems since a route must be created for the IR rays into the oven cavity, which route leads to the creation of an opening in the cavity wall through which microwaves pass into the grill bulge, from where the microwaves can leak out into the surrounding room.

In order to avoid such leakage a solution has been created, which is presented in EP 0 420 319. The invention defined in this patent aims to prevent the microwave field present in the grill bulge from leaking out into the surrounding room. In order to achieve this, measures are taken in two steps: the first step is the arrangement of a perforated metal sheet in the opening of the cavity wall so that this sheet physically shields the grill bulge from the cavity. Even though this shield shields off some of the microwaves, the resulting field in the grill bulge is still relatively strong, which causes problems with radiation leakage to the surrounding room. The second step is that in order to prevent this leakage to the surrounding room, one has attempted to insulate the grill bulge from the surroundings in such a way that the relatively substantial amount of microwaves which, despite the sheet, make their way into the grill bulge do not penetrate into the surrounding room. This insulation has substantially been created by the sheet being in electric contact with a metallic reflector arranged in the grill bulge, which reflector is used to reflect IR radiation from the grill elements in the oven cavity. The reflector and the sheet are electrically insulated from the walls of the oven cavity so that they form a cage, which acts as a microwave seal in relation to the surrounding room.

A special difficulty in this context are the electric connections of the grill elements, which connections function as antennae for the microwaves. The microwaves picked up by them can then escape from the grill bulge by the intermediary of those wires from the connections which lead out from the bulge. In order to prevent this, a specially configured shielding arrangement for the connections and their conductors are shown in the patent, which arrangement has the task of reflecting the microwaves back into the grill bulge.

OBJECTS OF THE INVENTION

The object of the present invention is to provide a method and a device which make the manufacture of the grill bulge and the grill elements including their connections to feeders considerably simpler and less expensive and improve the efficiency of the grill. In addition, one object of the method and the device according to the present invention is to increase the technical life of the grill elements.

SUMMARY OF THE INVENTION

The object of the invention is achieved by a microwave oven according to the independent claim 1 and a method according to the independent claim 12. Preferred embodiments of the invention are described in the dependent claims 2–11 and 13–17.

The invention is based on the insight that it is possible by means of the design of cavities to control their microwave-propagation properties in such a way that parts of them will be essentially microwave free.

According to one aspect of the present invention, a microwave oven is provided, to which is arranged a space for IR radiating means, which has a connection opening to the oven cavity, the space including its connection opening having dimensions which make their microwave-propagation properties such that the space becomes essentially microwave free.

This is achieved by the space being arranged in such a way that functionally it forms part of the oven cavity, i.e. its defining walls are electrically conductive and are in electric contact with the walls of the oven cavity. The connection opening can be completely open, but in a preferred embodiment of the present invention a type of grate is arranged in the connection opening.

According to the present invention, this essentially microwave-free space is advantageously achieved by the space and its connection opening to the actual oven cavity being arranged with dimensions such that they form a waveguide in which microwaves with the wavelength in question do not propagate.

What appears to be essential to the creation of this largely microwave-free space is the size of a characteristic dimension of the connection opening.

This characteristic dimension is preferably smaller than half a wavelength of the microwaves in question.

In a preferred embodiment the connection opening is elongated and the characteristic dimension of the connection opening is its width.

The length of the connection opening and the depth of the space are of lesser importance in this context.

According to a second aspect of the present invention, IR rays are generated in a special sub-cavity which, by the intermediary of a relatively large connection opening, is connected to the actual oven cavity, the sub-cavity including its connection opening having been given dimensions such that microwaves essentially do not propagate inside the sub-cavity.

The sub-cavity is preferably formed in connection with the ceiling of the oven cavity but can also be located in one of the walls or in the floor.

In a preferred embodiment of the present invention, the hollow space or the grill bulge is defined at least partly by an electrically conductive reflector, which is adapted to reflect IR radiation generated by a grill element, and which is in electric contact with the actual cavity walls.

According to a preferred embodiment of the present invention, a high temperature zone is created at the connection opening between the sub-cavity and the actual oven cavity, so that splashes of fat or the like from the foodstuff are burned.

A preferred embodiment of the present invention comprises a configuration, preferably a grate, which will be called a grate in the remainder of this application, which forms a surface which to a certain extent contains an electrically conductive material but which substantially contains openings or holes, which is arranged in the connection opening of the hollow space to the actual oven cavity. This grate can serve one or several of the following purposes depending on how it is configured.

The grate can be configured so that it prevents a user from coming into contact with the grill elements when removing foodstuffs from the oven. This is important since the grill elements can become very hot when used.

The grate can be configured or designed so that it reflects part of the microwave radiation which falls upon it, which further reduces the amount of microwave radiation entering the sub-cavity.

The grate can be configured so that it absorbs part of the IR radiation from the grill elements in order to create a high temperature zone around the grate. The reason why it is desirable to burn splashes is that fat and the like otherwise may soil the reflector, which considerably reduces its efficiency.

The grate can be configured so that it absorbs or reflects a large part of the IR rays which are directed at a certain spot or certain spots and absorbs or reflects a small part of the remaining IR rays. This makes it possible for only a small amount of IR rays to strike the oven door, for example, which means that it will not be heated to excessively high temperatures.

In a preferred embodiment of the present invention, the openings in the grate are elongated and are arranged essentially parallel to the oven door.

Since we have created a space which to a high degree is microwave free and since as a consequence there is no great need for special means which screen the space from microwaves, one embodiment of the present invention was equipped with a grate which, in comparison with the perforated metal sheets normally used, had very large openings. The reason for arranging a grate with large openings was that in this way users were prevented from coming into contact with the grill elements while, at the same time, the IR irradiation of foodstuffs in the oven was not significantly reduced.

The configuration chosen was a metal sheet in which were cut a number of longitudinal slots which terminated with short slots which were at right angles to the long slots, after which the sheet segments thus formed were bent upwards.

This configuration was found to have a great ability to reflect microwaves, i.e. the transmission into the grill space diminished further.

The fact that these larger openings provided further reduced transmission is most likely due to the capacitance which is formed over the openings and which leads to a capacitive current over the hole. This current causes a lowering of the impedance, which results in better reflection of the wave which otherwise would have passed through the opening.

On the basis of this insight an embodiment can be designed so that a three-dimensional capacitor configuration is achieved, which in comparison with a two-dimensional capacitor configuration leads to significantly higher capacitance. Consequently, three-dimensional capacitor configurations which have been manufactured in a different way from the one mentioned above can be used to achieve the same effect.

A preferred embodiment of such a grate is constructed by cutting longitudinal slots in a metal sheet which terminate in shorter slots which are essentially at right angles to the longitudinal slots in order for it to be possible to bend that part of the sheet upwards essentially at right angles to the plane of the sheet. In this way, we easily create a grate which has a large degree of openness in the plane of the sheet and which at the same time has a relatively large surface in a plane which is at right angles to the plane of the sheet. This large surface gives the above-mentioned three-dimensional capacitor configuration.

In addition, it is possible to design the grate in such a way that it exhibits a large surface for IR rays which are directed forwards towards the oven door and a small surface for IR rays which are directed towards the foodstuff which they are intended to grill, which ensures that as little grill capacity as possible is lost at the same time as the oven door is irradiated to the least extent possible in order to prevent it from becoming excessively hot.

To give a better understanding of the present invention, preferred embodiments will be described below with reference to the accompanying drawings, in which

DESCRIPTION OF PREFERRED EMBODIMENTS

Figure 1:
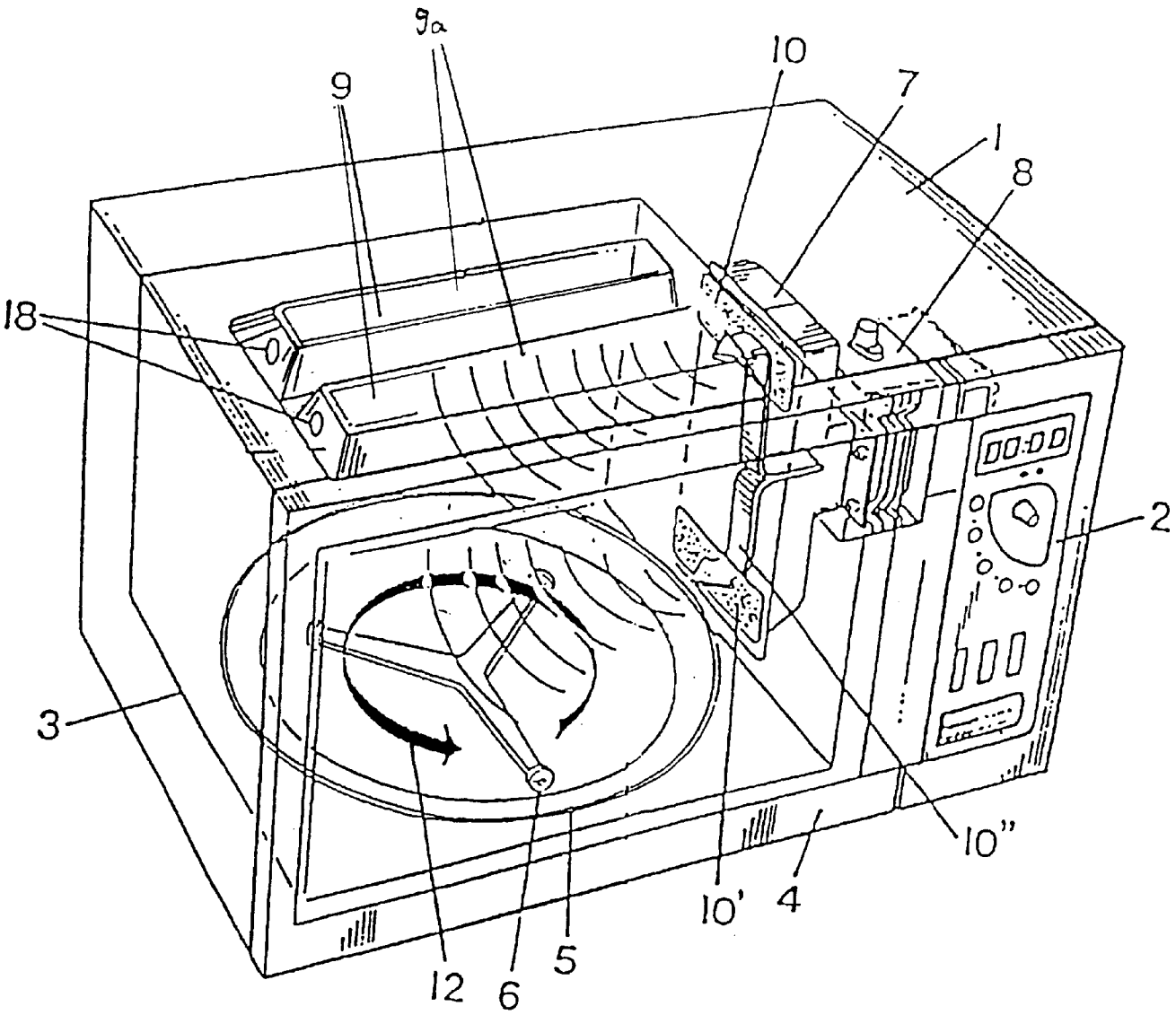
FIG. 1 shows a perspective view in section of a microwave oven comprising a grill bulge according to the present invention.

FIG. 1 shows a microwave oven according to the present invention. The oven comprises a casing 1, a control panel 2, a cavity 3 which is arranged in the casing and in which foodstuff is placed during the cooking process, and a door 4 for closing the cavity during cooking. Adjacent to the bottom of the cavity there is a rotating bottom plate 5 with an associated movement mechanism 6, which makes the plate with the food placed on it rotate in the direction of the arrow 12 during cooking. The bottom plate and the movement mechanism can be of a type which is easy to remove when a stationary load is desired. The figure also shows microwave-feeding means 7 and a microwave source 8 for generation of the microwaves. By the intermediary of the feeding means 7 the microwaves are fed through two feeder openings 10 and 10' arranged in one of the side walls of the cavity adjacent to the ceiling and the bottom of the cavity, respectively. In the ceiling of the cavity 3 two reflectors I and II (shown in FIG. 2) are arranged which define hollow spaces 9 which in this case are each covered with a protective cover 9*a* for protecting the reflectors and which each contain a grill element 18. The respective connection openings of the hollow spaces 9 to the actual oven cavity are elongated and extend parallel to the oven door and have a width which is two-fifths the wavelength of the microwaves. The hollow spaces themselves have a depth of just over one wavelength.

Figure 2:
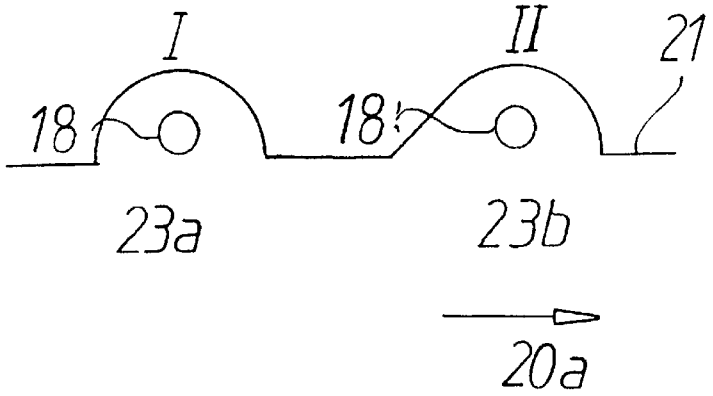
FIG. 2 shows a schematic view of a reflector combination in an embodiment of the present invention.

FIG. 2 shows two reflectors I and II which are arranged in the ceiling of the microwave oven and in which are arranged grill elements 18 for generating IR radiation. The reflectors I and II are in electric contact with at least one of the walls 21 which form the cavity 3. This electric contact makes the spaces 9 which are defined by the reflectors I, II into sub-cavities of the actual oven cavity 3. In this embodiment, the connection openings 23*a* and 23*b* have a width which is two-fifths the wavelength of the microwaves. As mentioned above, from the point of view of the microwaves, the reflectors together with their connection openings 23*a* and 23*b* form waveguides in which the microwaves do not propagate. As a result, the reflectors form sub-cavities, in which the field intensity of the microwave field is low, despite the fact that they are completely open to the actual oven cavity. The reason the reflectors shown in FIG. 2 have different shapes is so as to reduce the amount of IR radiation which falls on the oven door. The arrow 20*a* shows the direction in which the oven door is located.

Figure 3:
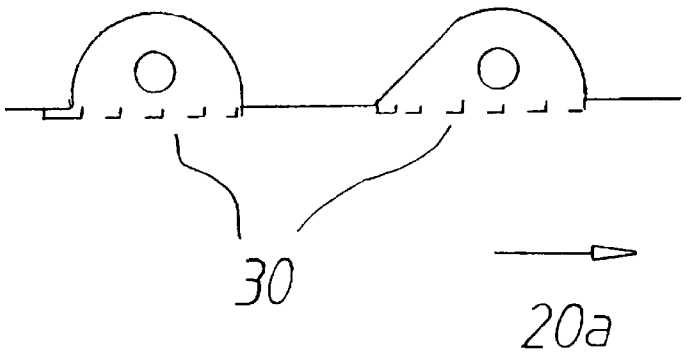
FIG. 3 shows a schematic view of the reflector combination in FIG. 2 but with grates arranged in the connection openings between the hollow spaces which are defined by the reflectors and the actual oven cavity.
Figure 4:
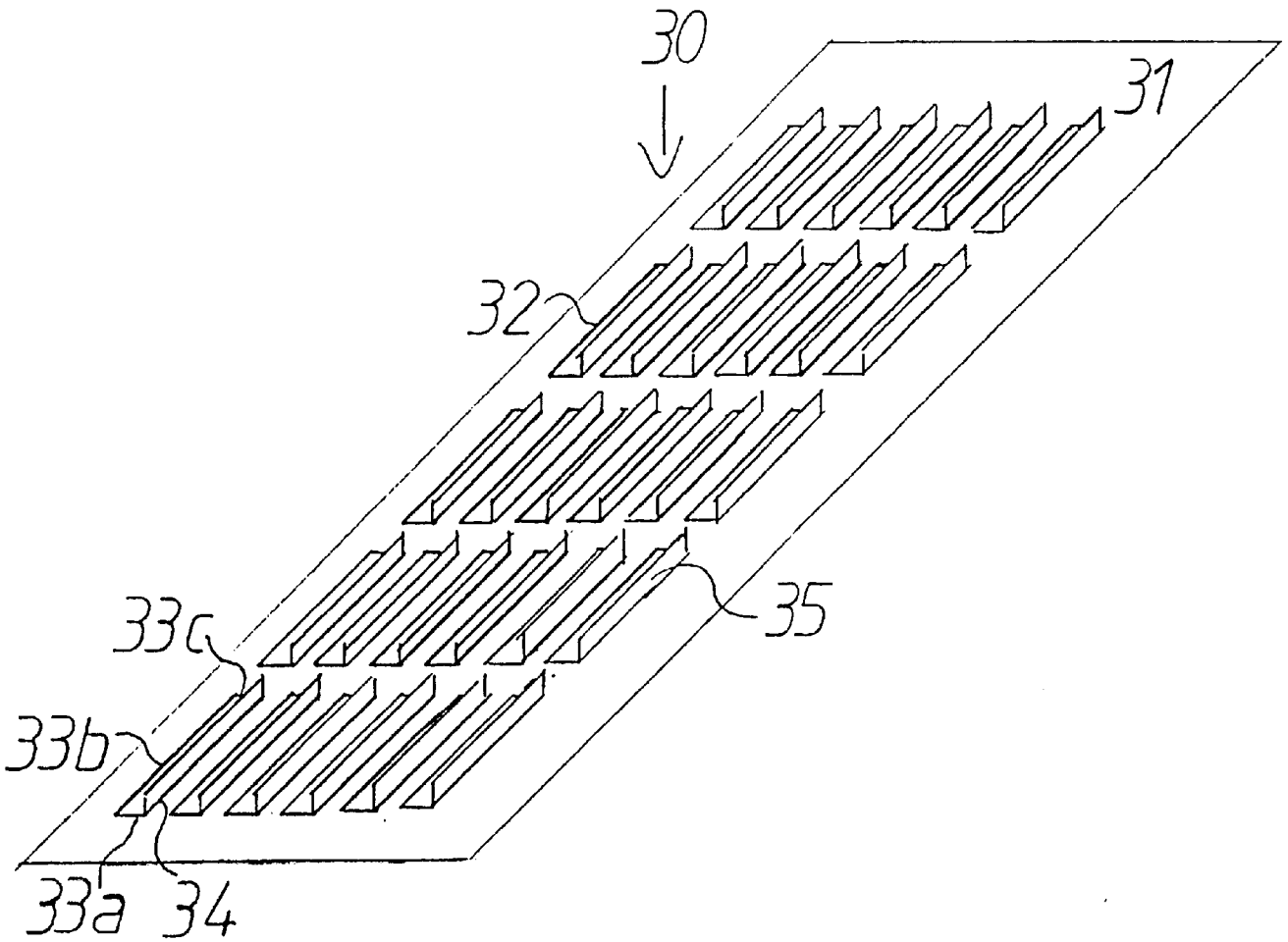
FIG. 4 shows a perspective view from above and at an angle of a grate which is employed in an embodiment of the present invention.

FIG. 3 shows the same reflector combination as FIG. 2 but with the difference that a grate 30 in accordance with what is shown in FIG. 4 has been arranged in the connection opening between the spaces which are formed by the reflectors I and II and the actual oven cavity 3. The grate 30 has three functions, firstly, it prevents a user from coming into contact with the grill elements 18 and getting burned, secondly, the grate reflects or absorbs some of the IR radiation which is directed at the oven door and, thirdly, the grate further reduces the transmission of microwaves into the spaces which are defined by the reflectors I and II.

As was mentioned above, it is the width (or the length depending on which direction is defined as width and which is defined as length) of the connection openings of the spaces to the actual oven cavity which is the determining dimension. This width should be less than half a wavelength, i.e. less than $\lambda/2$. The depth of the hollow space is of little or no importance.

The grill elements 18 are of the kind which contains a coil made of an electrically conductive material and is contained in a glass tube. The coil is caused to emit IR radiation by it being fed an electric current. By virtue of the minimal field inside the hollow space, the electric connections of the coil do not have to be shielded to any great extent with respect to microwaves, which makes the manufacture and installation of these connections cheaper and simpler than is the case with prior art.

FIG. 4 shows a grate 30 of the kind which in FIG. 3 is arranged in the connection opening between a reflector I and the actual oven cavity. The grate comprises a metal sheet 31 in which a number of holes 32 have been made by cutting slots along three edges 33*a*, 33*b* and 33*c* of the holes, and then bending the sheet upwards along the fourth edge 34. Thus, the grate comprises a number of sheet segments 35 standing straight up. The sheet segments 35 make the capacitor action of the holes 32 multiply since over each hole 32 a three-dimensional capacitor is obtained instead of an essentially two-dimensional capacitor which is the case if no edges are bent upwards. This three-dimensional capacitor configuration means that the shielding effect which the grate has on the microwaves increases considerably in comparison with what would have been the case with a sheet which instead forms an essentially two-dimensional capacitor configuration. In this embodiment, the sheet segments 35 are bent upwards and the distance between two adjacent sheet segments is equal to the height of the segments 35, which means that there is very little sheet material in the plane of the sheet 31. By using this manufacturing method a degree of openness of more than 90% can be achieved.

Since the sheet segments 35 in this embodiment are essentially at right angles to the plane of the sheet 31 they will absorb a large part of the IR radiation which is not directed essentially downwards towards the bottom of the oven and a small part of the IR radiation which is directed to the bottom of the oven and thus towards foodstuffs which have been put into the oven for cooking. Thus, since in this preferred embodiment we have made the grate with high porosity, a small part of the IR rays which are directed towards foodstuffs in the oven will be absorbed, while at the same time a relatively large part of the IR radiation which is directed towards the oven door, for example, is absorbed. These absorption and permeability qualities provide two advantages: firstly, the grill elements will only to a very small extent contribute to raising the temperature of the oven door which reduces the risk of a user getting burned, secondly, by virtue of the absorbed IR radiation a high temperature zone is created in and around the grate, which zone will burn splashes from the foodstuff which otherwise might hit the reflector and thus reduce its effectiveness. With the right configuration of the reflector/grate combination a cleaning effect can even be obtained, i.e. splashes which still hit the reflector will burn in time and thus form solid particles which fall off by themselves.

This burning and cleaning is a major advantage since the user does not have to clean the reflector. In addition to the fact that cleaning is time-consuming there is a large risk that the grill elements will be damaged since they are sensitive to mechanical influence.

The embodiments of the present invention which have been disclosed above should only serve as examples and thus make it easier to understand the invention. They should by no means be seen as limiting the scope of the present invention; instead the scope is defined in the appended claims.

The grate with a three-dimensional capacitor configuration and other advantages which has been described in both general terms and in the description of preferred embodiments can, of course, be used for shielding off microwaves in contexts other than in the sub-cavities which are defined in the present application.

What is claimed is:

1. A microwave oven with a grilling device, which comprises an oven cavity (3), with cavity walls, an oven door (4), a load zone (5) arranged in the oven cavity for receiving foodstuffs which are inserted into the oven, a microwave unit (7, 8, 10, 10') for feeding microwaves to the oven cavity, means (18) for generating IR radiation to the oven cavity, means defining a hollow space (9) located outside the actual oven cavity (3), which hollow space (9) has a connection opening (23*a*, 23*b*) to the actual oven cavity (3) and in which said means (18) for generating IR radiation are arranged, said means defining a hollow space being in electric contact with one of the cavity walls, said hollow space forming a sub-cavity which is connected to the actual oven cavity, characterised in that the microwave oven with a grilling device comprises a reflector (I, II) which is arranged behind said means (18) for generating IR radiation, for reflecting IR radiation towards the load zone (5), the reflector (I, II) being electrically conductive and being included in said means defining the hollow space, the connection opening (23*a*, 23*b*) of the hollow space to the actual oven cavity (3) being arranged with dimensions such that essentially no microwaves propagate inside the hollow space (9), means (30) which absorb IR radiation and which are arranged at the connection opening (23*a*,

23*b*) for providing a high temperature zone adjacent to said connection opening.

2. A microwave oven according to claim 1, characterised in that said means (30) for absorbing IR radiation are arranged so that they exhibit a small absorption area for IR rays which are directed towards the load zone (5) and a large absorption area for IR rays which are directed towards the oven door (4).

3. A microwave oven according to claim 1, characterised in that said means (30) for absorbing IR radiation comprise a grate which is arranged between the means (18) for generating IR radiation and the load zone (5), substantially in direct connection with said connection opening (23*a,* 23*b*).

4. A microwave oven according to claim 3, characterised in that said means (30) for absorbing IR radiation are formed so that a first side thereof facing said means for generating IR radiation exhibits a first surface, and a side arranged at essentially right angles to said first side, exhibits a second surface, said first surface being considerably smaller than said second surface.

5. A microwave oven according to claim 2, characterised in that said means (30) for absorbing IR radiation comprise a grate which is arranged between the means (18) for generating IR radiation and the load zone (5), in direct connection with said connection opening (23*a,* 23*b*).

6. A microwave oven according to claim 5, characterised in that said means (30) for absorbing IR radiation are formed so that a first side thereof facing said means for generating IR radiation exhibits a first surface, and a side arranged at essentially right angles to said first side, exhibits a second surface, said first surface being considerably smaller than said second surface.

7. A microwave oven according to claim 1, 2, 3, 4, 5 or 6 characterised in that said means (30) for absorbing IR radiation has a permeability to IR rays which is between 70 and 95%.

8. A microwave oven according to claim 1, characterised in that a characteristic dimension of the connection opening (23*a,* 23*b*) is less than half a wavelength of said microwaves.

9. A microwave oven according to claim 8, characterised in that the connection opening (23*a,* 23*b*) is elongated, and said characteristic dimension is the width of the connection opening.

* * * * *